US009427788B2

(12) United States Patent
Dauphinais

(10) Patent No.: US 9,427,788 B2
(45) Date of Patent: Aug. 30, 2016

(54) COOLING DEVICE FOR A ROLLING MILL WORK ROLL

(71) Applicant: Raymond P. Dauphinais, Marlborough, MA (US)

(72) Inventor: Raymond P. Dauphinais, Marlborough, MA (US)

(73) Assignee: PRIMETALS TECHNOLOGIES USA LLC, Alpharetta, GA (US)

( * ) Notice: Subject to any disclaimer, the term of this patent is extended or adjusted under 35 U.S.C. 154(b) by 371 days.

(21) Appl. No.: 14/078,703

(22) Filed: Nov. 13, 2013

(65) Prior Publication Data

US 2015/0128677 A1 May 14, 2015

(51) Int. Cl.
*B21B 27/10* (2006.01)

(52) U.S. Cl.
CPC ..... *B21B 27/10* (2013.01); *B21B 2027/103* (2013.01)

(58) Field of Classification Search
CPC ..... B21B 27/10; B21B 2027/103
USPC ..... 72/201; 62/373
See application file for complete search history.

(56) References Cited

U.S. PATENT DOCUMENTS 3,357,224 A * 12/1967 Muller ..... B21B 27/10 72/201
3,880,358 A 4/1975 Schaming
4,019,560 A 4/1977 Butz
4,061,010 A 12/1977 Dougan
4,226,108 A 10/1980 Economopoulos
4,250,951 A 2/1981 Christner
4,400,961 A 8/1983 Schaming
4,422,318 A 12/1983 Christ
4,688,724 A 8/1987 Pal
5,046,347 A * 9/1991 Crosato ..... B21B 27/10 72/201
5,697,169 A 12/1997 Jacob
5,855,134 A * 1/1999 Womelsdorf ..... B21B 31/078 72/200
6,385,989 B1 * 5/2002 Cassidy ..... B21B 27/10 62/373
6,904,953 B2 6/2005 Fecht
8,978,437 B2 * 3/2015 Malas ..... B21B 27/10 72/201
2002/0162374 A1 * 11/2002 Plicht ..... B21B 45/0209 72/201
2007/0175255 A1 * 8/2007 Pawelski ..... B08B 3/022 72/201
2011/0036555 A1 * 2/2011 Plicht ..... B21B 27/10 165/287
2015/0128677 A1 * 5/2015 Dauphinais ..... B21B 27/10 72/201

FOREIGN PATENT DOCUMENTS

GB 2111885 7/1983
JP S63290610 11/1988

OTHER PUBLICATIONS

International Search Report and Written Opinion mailed Jan. 21, 2015 in corresponding PCT Application No. PCT/US2014/063085.

* cited by examiner

*Primary Examiner* — David B Jones
(74) *Attorney, Agent, or Firm* — Gesmer Updegrove LLP

(57) ABSTRACT

A cooling device comprises a manifold housing having a generally concave inner edge configured and dimensioned to surround a surface area of a work roll in a rolling mill. The manifold housing is of a modular design having multiple constituent sections that are internally configured to simultaneously apply both a liquid coolant and a pressurized gas to the surface area of the work roll.

11 Claims, 4 Drawing Sheets

COOLING DEVICE FOR A ROLLING MILL WORK ROLL

BACKGROUND

1. Field

Embodiments of the present invention relate generally to the cooling of work rolls in a rolling mill, and are concerned in particular with improving the cooling efficiency of liquid coolants such as water or the like applied to the roll surfaces.

2. Description of Related Art

In a known arrangement, as disclosed for example in U.S. Pat. No. 6,385,989 (Cassidy), a coolant delivery device partially surrounds a work roll and serves as a supply manifold for nozzles arranged to apply cooling water to the roll surface. Although such devices operate in a generally satisfactory manner, it has now been determined that their efficiency is compromised by the Leidenfrost effect, a phenomenon in which a liquid, in near contact with a body significantly hotter than the liquid's boiling point, produces an insulating vapor layer that keeps the liquid from boiling rapidly. The thermal conductivity of the vapor is much poorer than that of the liquid, resulting in reduced cooling efficiency.

SUMMARY

Broadly stated, embodiments of the present invention are directed to disrupting the Leidenfrost effect, thereby increasing the cooling efficiency of a liquid coolant being applied to a work roll surface.

In exemplary embodiments of the present invention, the application of the liquid coolant to a surface area of a work roll is accompanied by the simultaneous application to the same surface area of a pressurized gas.

Typically, the liquid coolant is water and the pressurized gas is compressed air.

In a preferred embodiment of a cooling device in accordance with the present invention, a manifold housing has a generally concave inner edge configured and dimensioned to surround a surface area of the work roll. The housing includes a first means for applying water or other like liquid coolant to the work roll surface area via first outlets arrayed along the housing inner edge, and second means for simultaneously applying compressed air or other like pressurized gas to the same work roll surface area via second outlets also arrayed along the inner housing edge.

Preferably the first nozzles are located in two parallel first planes, and the second nozzles are located in a second plane between and parallel to the first planes.

These and other features, objectives and advantages of the present invention will become more apparent upon reading the following detailed description in conjunction with the accompanying drawings.

DETAILED DESCRIPTION

The components described hereinafter as making up the various embodiments are intended to be illustrative and not restrictive. Other suitable components that are capable of performing the same or similar functions as well as the materials described herein are intended to be encompassed within the scope of the present invention.

Figure 2:
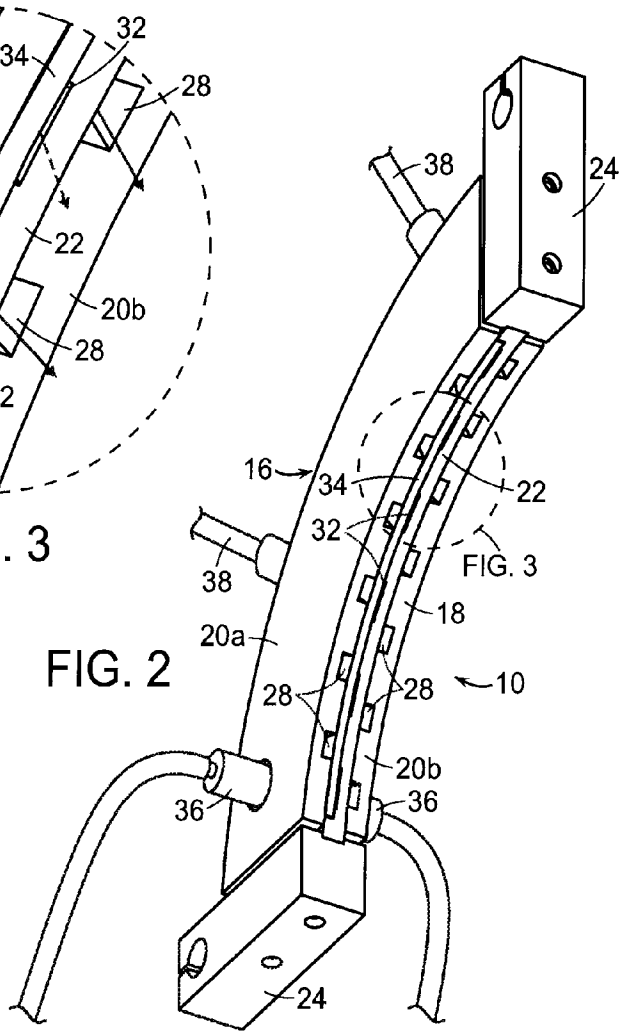
FIG. 2 is a perspective view of the cooling device shown in FIG. 1.
Figure 3:
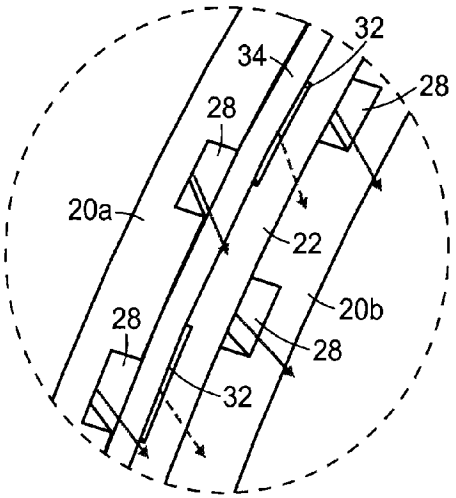
FIG. 3 is an enlarged view of the circled portion shown in FIG. 2.
Figure 1:
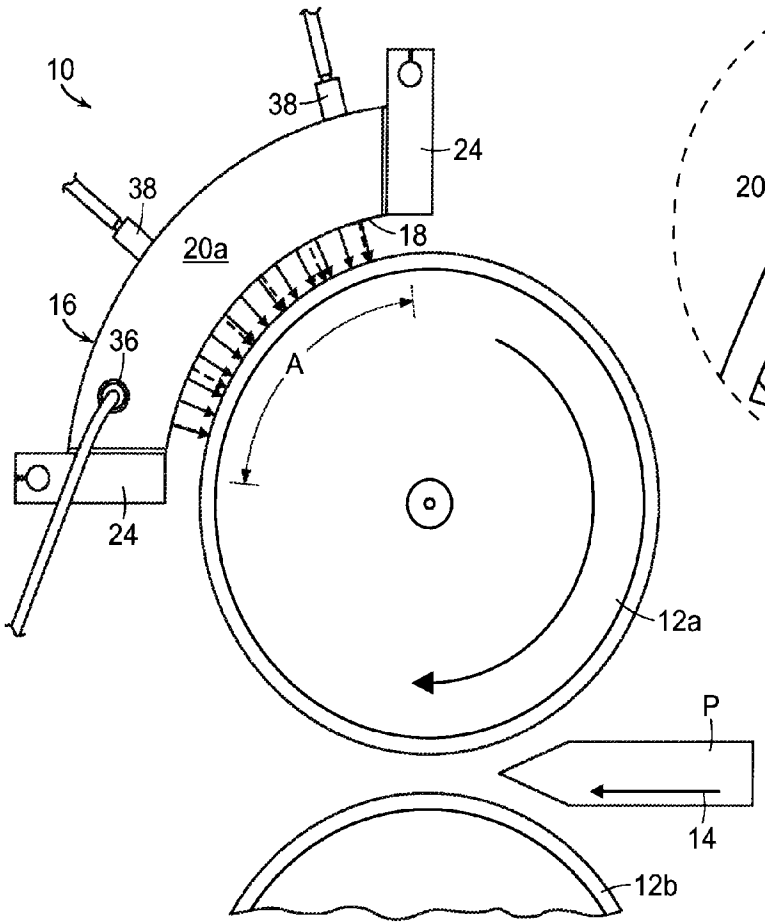
FIG. 1 is a side elevational view of a cooling device in accordance with an exemplary embodiment of the present invention, shown in an operative position adjacent to a rolling mill work roll.
Figure 5:
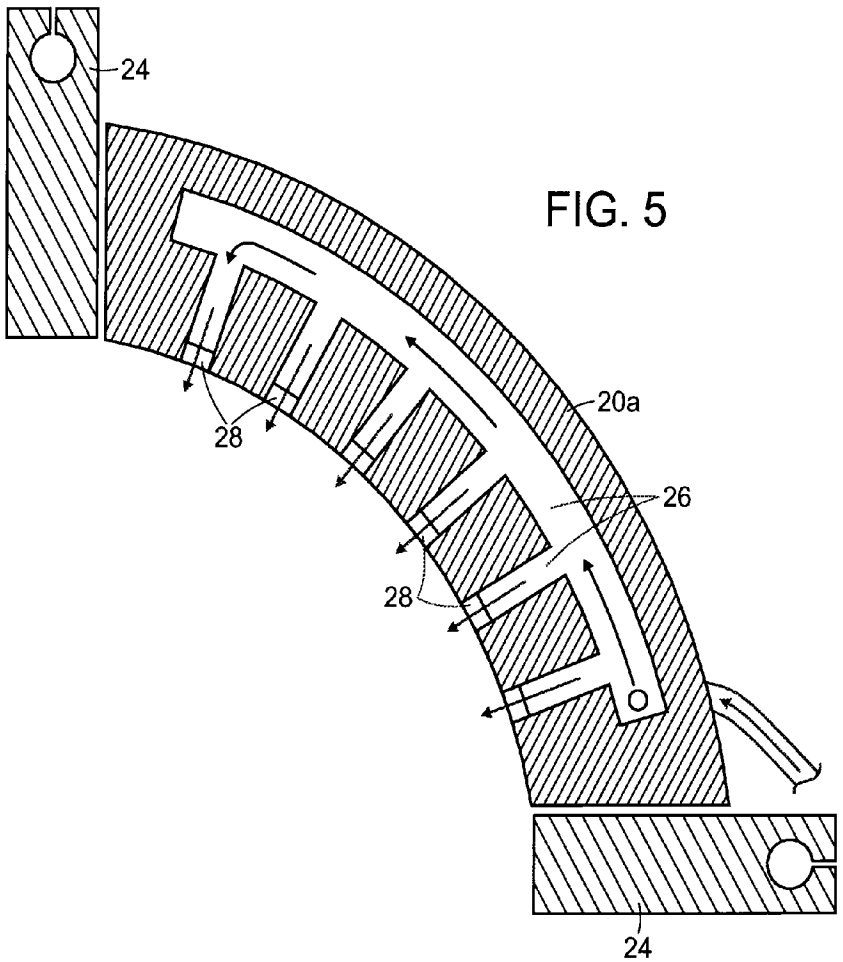
FIGS. 5 and 6 are sectional views taken respectively along lines 5-5 and 6-6 of FIG. 4.

With reference initially to FIG. 1, a cooling device in accordance with an exemplary embodiment of the present invention is generally depicted at 10 at a location adjacent to a work roll 12*a*. Work roll 12*a* and a companion work roll 12*b* define a roll pass therebetween configured and dimensioned to roll a product "P" moving in the direction diagrammatically indicated by arrow 14.

The cooling device 10 comprises a manifold housing 16 having a generally concave inner edge 18 configured and dimensioned to surround a surface area "A" of the work roll 12*a*.

With reference additionally to FIGS. 2-7, it will be seen that the manifold housing 16 may comprise a modular assembly of exterior first sections 20*a*, 20*b* sandwiching an interior second section 22 therebetween. End blocks 24 or the like may serve as the means for mounting the cooling device to a mill housing or other like support structure (not shown).

Networks of first grooves 26 on the interior surfaces of the first housing sections 20*a*, 20*b* comprise a first means for applying a liquid coolant to the work roll surface area A via first outlets 28 arrayed along the inner edge 18 of the manifold housing 16.

Figure 6:
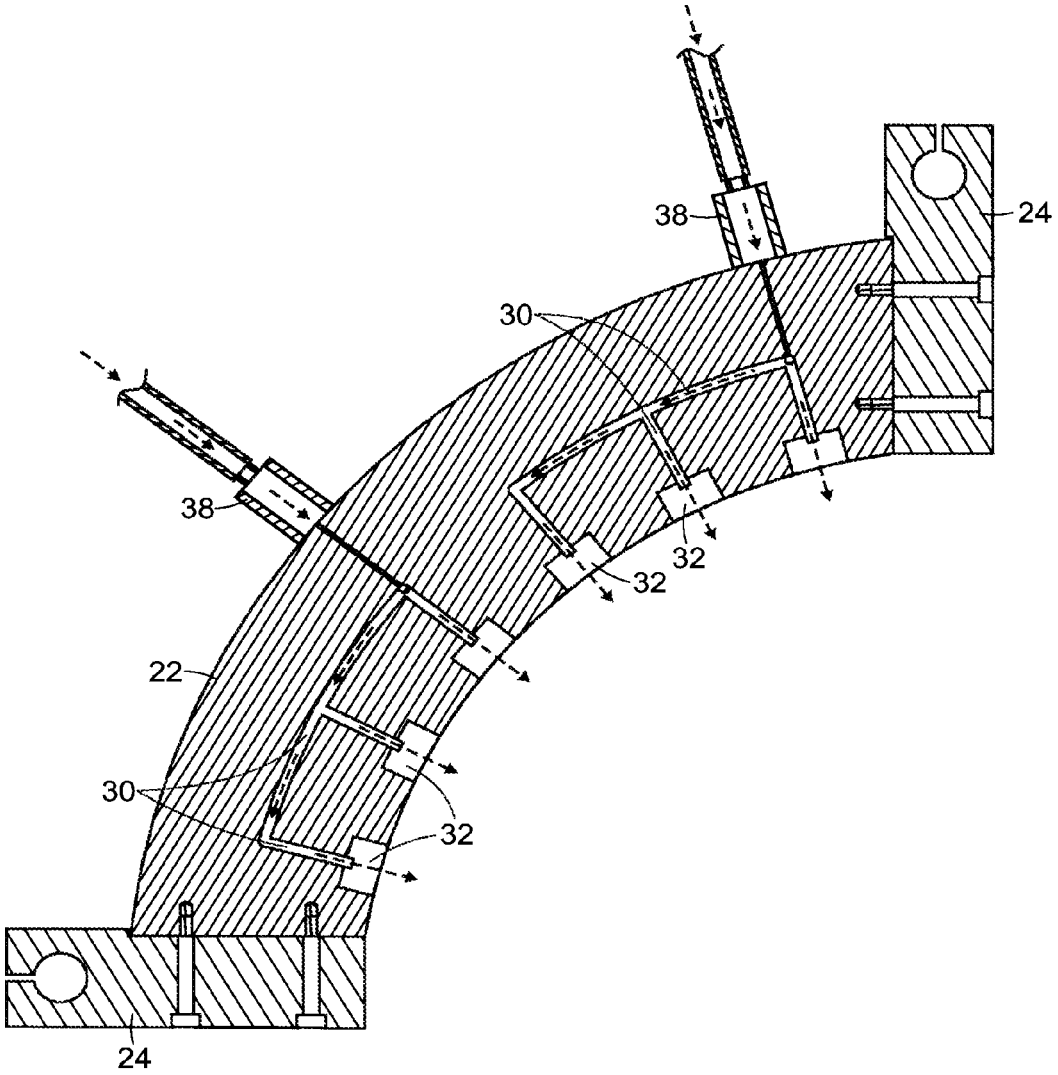
Figure 7:
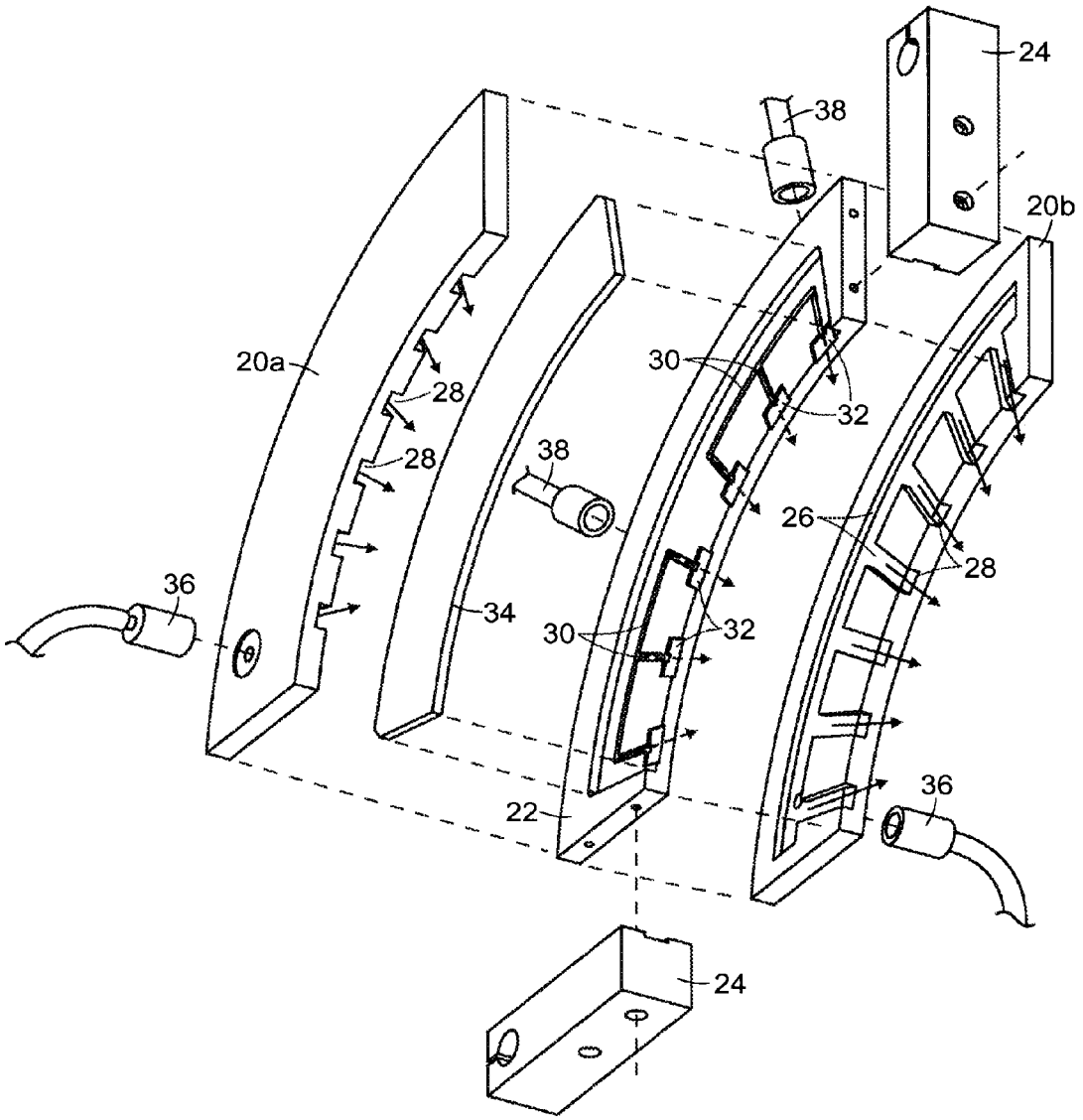
FIG. 7 is an exploded view of the cooling device shown in FIGS. 1, 2 and 4.

With reference to FIG. 6, A network of second grooves 30 in a surface of the interior second housing section 22 comprises a second means for applying a pressurized gas to the work roll surface area A via second outlets 32 also arrayed along the inner edge 18 of the manifold housing 16.

Figure 4:
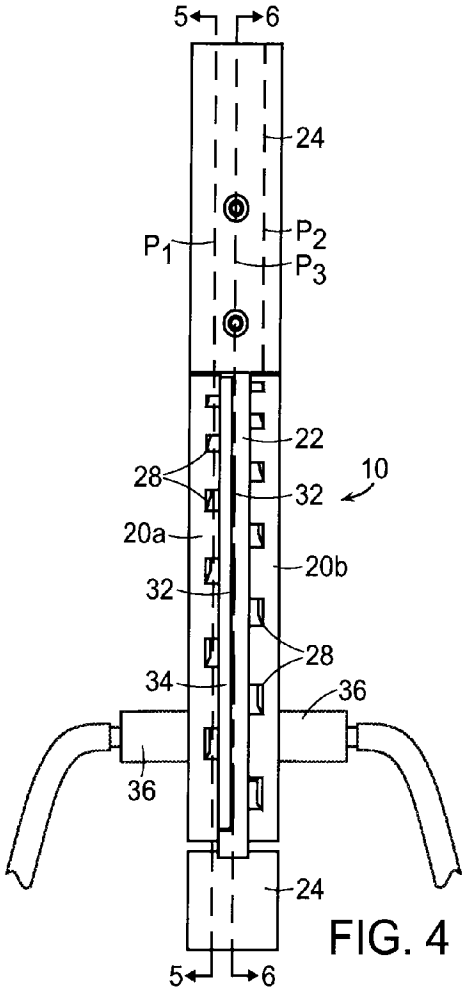
FIG. 4 is an end view of the cooling device shown in FIGS. 1 and 2.

As can best be seen in FIG. 4, the first outlets 28 are alternately arranged in a staggered relationship in two parallel first planes $P_1$, and the second outlets 32 are arranged in a second plane $P_2$ between and parallel to the first planes $P_1$.

The network of first grooves 26 on the inner surface of exterior first section 20*b* are closed by an abutting surface of the interior second section 22. The network of second grooves 30 are closed by an interior cover plate 34.

The network of first grooves 26 on the interior surface of exterior first section 20*a* are closed by an outer abutting surface of the cover plate 34.

The networks of first grooves 26 may be supplied by liquid coolant received via external connections 36, and the network of second grooves 30 may be similarly supplied with pressurized gas via external connections 38.

In FIGS. 1, 3 and 5-7, the application of liquid coolant is diagrammatically depicted by solid arrows, and the application of pressurized gas is similarly diagrammatically depicted by broken arrows.

The modular design of the cooling device 10 accommodates disassembly of the constituent sections 20*a*, 20*b*, 22 for periodic cleaning of the groove networks 26, 30 and associated outlets 28, 32. The groove networks and outlets are machined into the housing sections, and as such can be tailored to suit specific applications.

The cooling device of the present invention can readily be made from many different materials including metal plate, cast metal, plastic, ceramic, or composite materials. Thus, in a rolling mill environment where cooling water can often have entrained abrasive particles, an abrasion resistant material can be used. If the cooling water contains minerals that can adhere to passage walls, a non-stick lining or coating can be applied to interior surfaces. Corrosion-resistant coating may also be employed where appropriate.

The geometry of the manifold conduit can also be varied to provide each delivery outlet with near equal pressure thereby further optimizing coolant delivery.

Although not shown, it is to be understood that a second cooling device in accordance with the present invention and as described above is employed to cool the companion work roll 12*b*.

In light of the foregoing, it will now be understood that in accordance with the present invention, the application of a liquid coolant to a surface area of a work roll is simultaneously accompanied by the application of a pressurized gas to the same surface area. The application of pressurized gas serves to disrupt and eliminate or at least significantly reduce the Leidenfrost effect, thereby beneficially enhancing cooling efficiency.

What is claimed is:

1. A cooling device for a work roll in a rolling mill, said device comprising:

a manifold housing having a generally concave inner edge configured and dimensioned to surround a surface area of the work roll;

first means for applying a liquid coolant to said surface area via first outlets arrayed along the inner edge of said housing; and second means for simultaneously applying pressurized gas to said surface area via second outlets also arrayed along the inner edge of said housing, wherein said first nozzles are located in parallel first planes, and said second nozzles are located in a second plane between and parallel to said first planes, and wherein said first nozzles are alternately arranged in a staggered relationship on opposite sides of said second plane.

2. The cooling device of claim 1 wherein said liquid coolant is water and said pressurized gas is compressed air.

3. The cooling device of claim 1 wherein said manifold housing comprises a modular assembly of exterior first sections sandwiching an interior second section therebetween, said first means comprising a network of first grooves in interior surfaces of said first sections, and said second means comprises a network of second grooves in a surface of said second section.

4. The cooling device of claim 3 wherein said second grooves are closed by an internal cover plate.

5. The cooling device of claim 3 wherein said internal cover plate also closes the first grooves in the interior surface of one of said first sections.

6. The cooling device of claim 5 wherein the first grooves of the other of said first sections are closed by said second section.

7. A cooling device for a work roll in a rolling mill, said apparatus comprising:

a manifold housing having a generally concave inner edge configured and dimensioned to surround a surface area of the work roll, said housing comprising exterior first sections sandwiching an interior second section therebetween;

first means comprising networks of first grooves on interior surfaces of said first sections for applying a liquid coolant to said surface area via first outlets arrayed along the inner edge of said housing; and second means comprising a network of second grooves on said interior second section for simultaneously applying a pressurized gas to said surface area via second outlets also arrayed along the inner edge of said housing.

8. A method of cooling a work roll in a rolling mill, said method comprising:

applying a liquid coolant to a surface area of the work roll; and simultaneously applying a pressurized gas to the same surface area.

9. The method of claim 8 wherein said liquid coolant is water and said pressurized gas is compresses air.

10. The method of claim 8 wherein said liquid coolant is applied to said surface area at spaced locations in two parallel first planes, and wherein said compressed gas is applied to said surface area in a second plane between and parallel to said first planes.

11. A cooling device for a work roll in a rolling mill, said device comprising:

a manifold housing having a generally concave inner edge configured and dimensioned to surround a surface area of the work roll;

first means for applying a liquid coolant to said surface area via first outlets arrayed along the inner edge of said housing; and second means for simultaneously applying pressurized gas to said surface area via second outlets also arrayed along the inner edge of said housing, wherein said manifold housing comprises a modular assembly of exterior first sections sandwiching an interior second section therebetween, said first means comprising a network of first grooves in interior surfaces of said first sections, and said second means comprises a network of second grooves in a surface of said second section.

* * * * *